US006468138B1

(12) United States Patent
Toyama et al.

(10) Patent No.: US 6,468,138 B1
(45) Date of Patent: Oct. 22, 2002

(54) POROUS GRINDING TOOL AND METHOD FOR GRINDING A ROLL

(75) Inventors: Noukou Toyama, Kamiminochi-gun (JP); Kenichi Kazama, Kamiminochi-gun (JP)

(73) Assignee: Shinano Electric Refining Co., Ltd., Tokyo (JP)

( * ) Notice: Subject to any disclaimer, the term of this patent is extended or adjusted under 35 U.S.C. 154(b) by 0 days.

(21) Appl. No.: 09/345,897

(22) Filed: Jul. 1, 1999

(30) Foreign Application Priority Data

Jul. 2, 1998 (JP) ..... 10-202741

(51) Int. Cl.[7] ..... B24B 1/00

(52) U.S. Cl. ..... 451/49; 451/259; 451/59; 451/532

(58) Field of Search ..... 451/49, 259, 242, 451/243, 532, 526, 142, 163, 159, 59; 51/293, 295, 309

(56) References Cited

U.S. PATENT DOCUMENTS 4,671,017 A * 6/1987 Ideue et al. ..... 51/49
4,716,687 A * 1/1988 Tsukamoto et al. ..... 51/131.1
4,920,702 A * 5/1990 Kloss et al. ..... 51/170 R
4,989,375 A * 2/1991 Henmi et al. ..... 51/209 R
5,056,268 A * 10/1991 Wolff ..... 51/170 MT
5,060,424 A * 10/1991 Sato et al. ..... 51/209 R
5,383,306 A * 1/1995 Michalon et al. ..... 451/106
5,542,875 A * 8/1996 Ichiguchi ..... 451/533
5,667,540 A * 9/1997 Chesley et al. ..... 451/538
5,868,806 A * 2/1999 Nishio et al. ..... 451/539
5,958,794 A * 9/1999 Bruxvoort et al. ..... 438/692

FOREIGN PATENT DOCUMENTS

JP 7-27755 5/1995

OTHER PUBLICATIONS

English translation of JP 10109273 A Abstract (1998).
English translation of JP 2–33264 Abstract (1990).

* cited by examiner

*Primary Examiner*—Timothy V. Eley
*Assistant Examiner*—Hadi Shakeri
(74) *Attorney, Agent, or Firm*—Millen, White, Zelano & Branigan, P.C.

(57) ABSTRACT

A porous, roll-grinding tool has an abrasive surface which is adapted to contact and grind the surface of a roll and configured to a planar polygonal shape having 4 to 20 sides. Using the grinding tool, a roll can be ground within a satisfactory dimensional tolerance, with feed marks crossing the circumferential direction of the roll at a small feed mark pitch inclination angle, so that no streaky printing defects will be produced when the ground roll is used in printing.

7 Claims, 4 Drawing Sheets

POROUS GRINDING TOOL AND METHOD FOR GRINDING A ROLL

This invention relates to a porous grinding tool and method for grinding a roll to a mirror finish. More particularly, it relates to a porous grinding tool and method suitable for grinding a gravure printing copper-plated roll.

BACKGROUND OF THE INVENTION

Copper-plated rolls for use in gravure printing are typically in the form of a solid or hollow cylindrical iron core which is copper plated. The roll is ground at its surface with a porous grinding tool to a mirror finish such as to enable satisfactory gravure plate-making and printing. One typical roll grinding process is described with reference to FIG. 1. A copper-plated roll 1 for gravure printing is rotated about its axis at a predetermined rotational speed. A porous grinding tool 2 is placed in contact with the surface of the rotating roll 1 while the grinding tool 2 is rotated abut its axis and moved, preferably back and forth, along the axial direction of the roll. In this way, the surface of the roll 1 is ground to a mirror finish with the grinding tool 2. For surface grinding of the roll 1, a wet grinding procedure is often employed. Specifically, the load applied to the grinding tool 2 is adjusted so that the grinding tool 2 may contact the surface of the roll 1 over an appropriate area and under an appropriate pressure, and the position of the grinding tool 2 relative to the roll 1 is properly adjusted. The grinding tool 2 and the roll 1 are rotated about their respective axes at appropriate rotational speeds and the grinding tool 2 is moved back and forth along the axial direction of the roll 1 while water is being sprayed to the grinding zone from a nozzle (not shown) disposed alongside the roll.

In the prior art, the grinding tool 2 is configured as a disk or short cylinder as shown in FIG. 2, typically having a diameter of about 200 mm and a thickness of 50 to 100 mm. The grinding tool 2 is provided at its center with a through-hole 3. A hollow rotating arbor 4 (FIG. 1) is connected to the back surface of the disk-shaped grinding tool 2 so as to surround the through-hole 3. The abrasive surface of the grinding tool 2 is perpendicular to the rotating arbor 4. The through-hole 3 in the grinding tool 2 and the bore of the rotating arbor 4 are used to draw off and discharge grinding debris from the grinding zone.

In the above-described grinding method, the rotational axis of the roll is perpendicular to the rotational axis of the grinding tool. The prior art grinding method using a porous grinding disk ensures that the gravure printing copper-plated roll on its surface is ground to a mirror finish at a high dimensional precision. However, feed marks can be left on the roll surface due to the feed rate of the grinding disk. The use of a grinding disk has the effect of leaving on the surface of the roll, upon completion of grinding, grinding marks in the form of a plurality of circumferentially extending, generally parallel and closely spaced streaks as shown in FIG. 3. Gravure printing using a roll bearing such streaky grinding marks results in impressions bearing streaky defects, failing to meet the requirements of the current art for high precision, high quality printed matter.

SUMMARY OF THE INVENTION

An object of the invention is to provide a porous grinding tool for grinding a roll to a mirror finish at a high dimensional precision without leaving streaky feed marks of a large inclination angle on the surface of the roll. Another object of the invention is to provide a method for grinding a roll using the grinding tool.

We have found that a porous grinding tool for use in grinding of a roll is improved by changing the planar shape of at least its working surface from the conventional circular shape to a polygonal shape having from four (4) to twenty (20) sides. The grinding tool with a polygonal working surface is successful in grinding a roll at a high dimensional precision without leaving feed marks due to the tool feed as streaks parallel to the circumferential direction of the roll, but as streaks of a small feed mark pitch inclination angle. When the grinding tool is applied to a roll for gravure printing the roll can be ground to a sufficient finish to produce printed matter without streaky defects.

In a first aspect, the invention provides a porous, roll-grinding tool having an abrasive surface adapted to contact and grind the surface of a roll. The abrasive surface is configured to a planar polygonal shape having from four (4) to twenty (20) sides.

A second aspect of the invention provides a method for grinding the surface of a roll having an axis, comprising the steps of rotating the roll about the roll axis, and placing a porous grinding tool in contact with the surface of the rotating roll while rotating the grinding tool about an axis thereof and moving the grinding tool along the axial direction of the roll, thereby grinding the roll surface with the grinding tool. The grinding tool has an abrasive surface which is configured to a planar polygonal shape having from 4 to 20 sides.

DETAILED DESCRIPTION OF THE INVENTION

Figure 1:
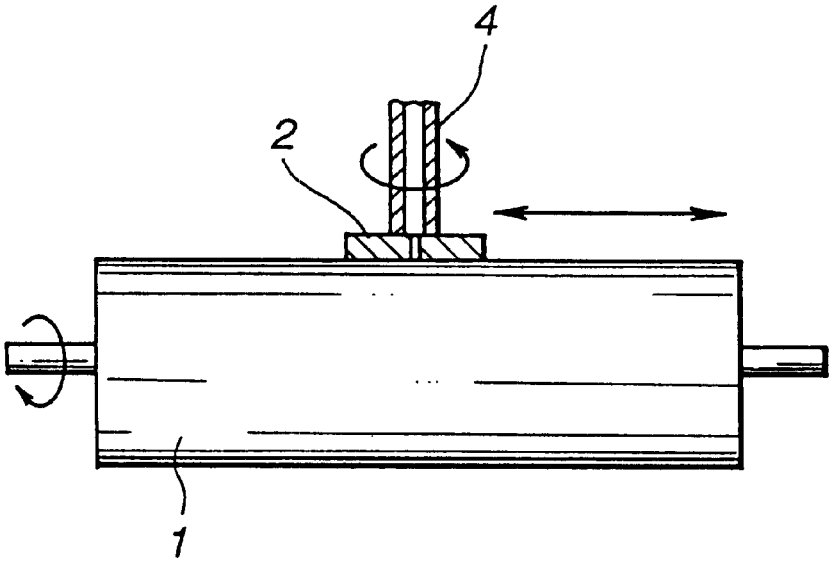
FIG. 1 PRIOR ART
FIG. 1 illustrates how to grind a roll with a grinding tool.
Figure 2:
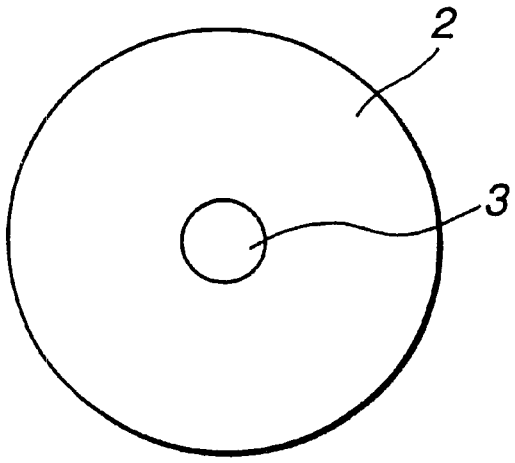
FIG. 2 PRIOR ART
FIG. 2 is a plan view of a prior art circular grinding tool.
Figure 3:
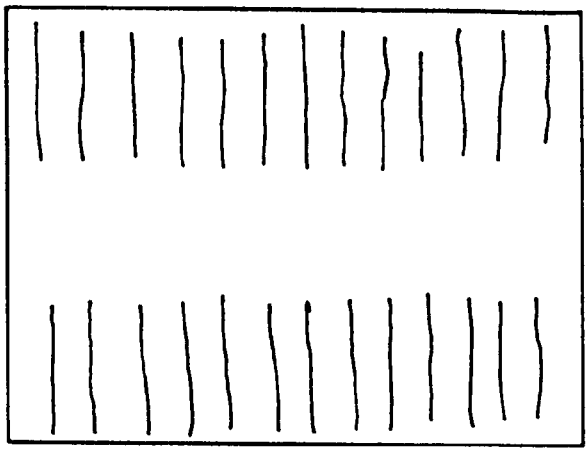
FIG. 3 is a plan view showing feed marks left on a roll when ground with the prior art circular grinding tool.
Figure 4:
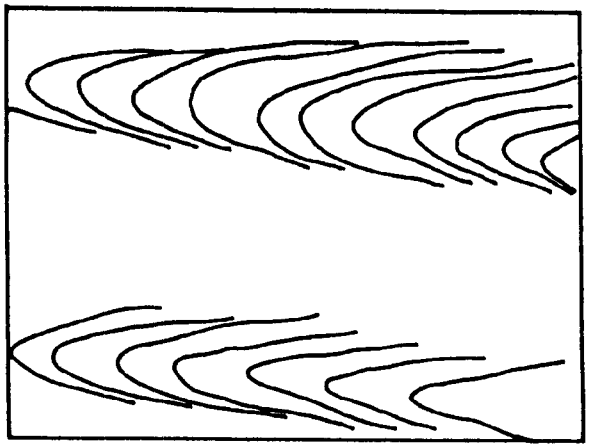
FIG. 4 is a plan view showing feed marks left on a roll when ground with a regular quadrilateral grinding tool according to one embodiment of the invention.
Figure 5:
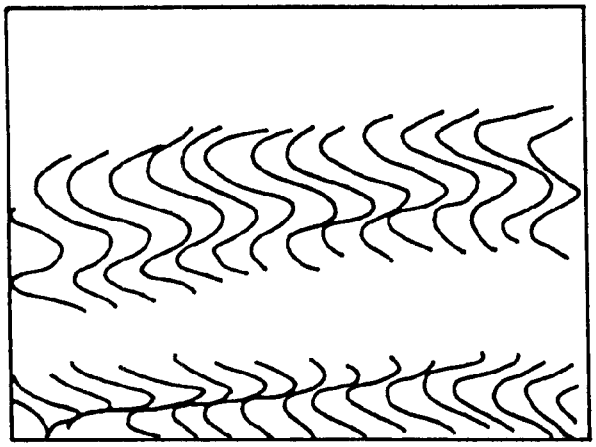
FIG. 5 is a plan view showing feed marks left on a roll when ground with a regular hexagonal grinding tool according to another embodiment of the invention.
Figure 6:
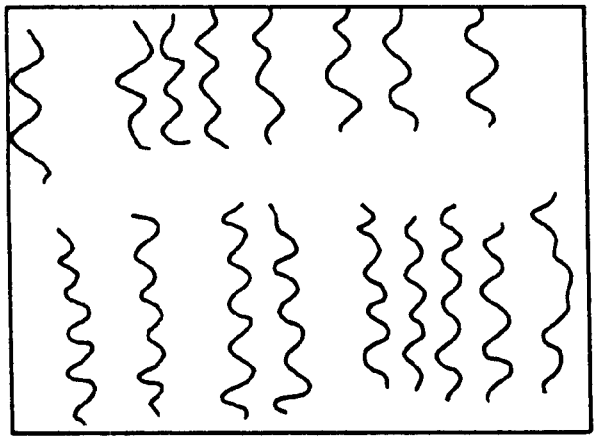
FIG. 6 is a plan view showing feed marks left on a roll when ground with a regular 20-sided shape grinding tool according to a further embodiment of the invention.

The porous grinding tool of the invention is used in grinding rolls, especially rolls for gravure printing. The grinding tool has a working or abrasive surface which comes in abutment with the roll surface for grinding it. The abrasive surface is configured to a planar polygonal shape having from 4 to 20 sides, preferably a regular polygonal shape. If the abrasive surface is triangular, there arise problems that the effective area of the grinding tool available for grinding is extremely reduced, failing to achieve grinding at a high dimensional tolerance, that the grinding pressure per unit area of the grinding tool is increased so that the grinding tool itself is markedly worn or consumed, and that the water applied to the grinding zone during grinding operation is splashed in the rotational direction of the grinding tool, worsening the working environment. On the other hand, a polygonal shape of more than 20 sides is approximate to a circle and has a risk of leaving streaky feed marks with a large inclination angle on the ground roll surface as with the prior art circular grinding wheel.

The dimensions of the grinding tool may be determined as appropriate in accordance with the outer diameter and other factors of the roll to be ground. For a roll having an outer diameter of about 100 to about 500 mm, for example, the grinding tool preferably has an outer size (i.e., diagonal length) of about 150 to about 300 mm, especially about 180 to about 220 mm and a thickness of about 50 to about 100 mm. A through-hole may be drilled in the grinding tool for drawing off and discharging debris as described earlier. The through-hole usually has a diameter of about 10 to about 50 mm.

The abrasive tool may be formed by mixing abrasive grains with a resin, molding the mixture into a compact of the desired shape, and curing the compact. The abrasive grains used herein are preferably fine grains having a mean grain size of about 40 to about 1 $\mu$m and formed of silicon carbide, alumina, chromium oxide, cerium oxide, zirconium oxide, and zirconia sand and mixtures of any of these.

The resins to be admixed with abrasive grains are preferably thermosetting resins, for example, polyvinyl acetal resins, phenolic resins, melamine resins, urea resins, acrylic resins, methacrylic resins, epoxy resins, and polyester resins, alone or in admixture of two or more of these. When the hardness and wear of the grinding tool are taken into account, the use of polyvinyl acetal resin is preferred. Often used is the polyvinyl acetal resin that is obtained by adding water to a fully saponified product of a polyvinyl alcohol resin to form an aqueous solution, adding an aldehyde to the solution, and effecting acetalization reaction in the presence of an acid catalyst such as hydrochloric acid or sulfuric acid. Usually a grinding tool is prepared by molding a slurry of the polyvinyl acetal resin and abrasive grains into a compact, followed by curing. If it is desired to admix another thermosetting resin with the polyvinyl acetal resin, the other thermosetting resin may be introduced into the slurry before molding. Alternatively, after a grinding tool is solidified, it is impregnated with the other thermosetting resin so that the resin may infiltrate into pores in the grinding tool. It is also acceptable to combine these procedures.

The respective components are admixed in an appropriate proportion although it is desired to admix 10 to 30% by weight of the polyvinyl acetal resin, 5 to 20% by weight of the other thermosetting resin, and at least 50% by weight of abrasive grains. With less than 10% by weight of the polyvinyl acetal resin, the grinding tool would become less porous and lose elasticity or have a too high hardness. With less than 5% by weight of the other thermosetting resin, the binding force between the porous portion based on the polyvinyl acetal resin and fine abrasive grains would become weak, resulting in a grinding tool having a too low hardness. Since fine abrasive grains provide the grinding tool with cutting edges, less than 50% by weight of the abrasive grains indicating a relatively increased proportion of polyvinyl acetal resin and/or other thermosetting resin results in a grinding tool having a too high hardness to allow for releasing of abrasive grains (or self-dressing). This not only worsens the cutting performance of abrasive grains which, in turn, exacerbates the surface roughness of the roll ground therewith, failing to accomplish a mirror finish, but also increases the frequency of loading, causing scratch occurrence.

More specifically, the grinding tool is prepared by first mixing a completely saponified product of a polyvinyl alcohol resin with another thermosetting resin and fine abrasive grains, and effecting acetalization as described above, thereby forming a slurry. The slurry is placed in a container of predetermined dimensions and maintained at about 50 to 70° C. for about 15 to 25 hours for reaction and solidification. The resulting porous compact is washed with water and dried, optionally impregnated again with a further thermosetting resin and dried. The compact is finally hot worked at about 150 to 300° C. for about 5 to 50 hours. The compact is perforated with a through-hole as by drilling, adjusted in thickness, worked on side surfaces, and end-milled by an NC drilling/tapping machine, obtaining a grinding tool of the desired polygonal shape.

The porous grinding tool is mounted on a conventional gravure roll grinding machine such as an external cylindrical grinding machine or another grinding machine. Grinding is carried out while the tool load, the rotational speed of the tool, the rotational speed of a roll to be ground, and the feed rate of the tool (the traverse speed of the tool in a direction parallel to the rotating axis of the roll to be ground) are properly adjusted and set. Specifically, wet grinding is carried out by the same procedure as described earlier in conjunction with FIG. 1. Preferred conditions include a roll rotational speed of about 50 to 150 rpm, especially about 80 to 120 rpm, a tool rotational speed of about 300 to 1,000 rpm, especially 500 to 800 rpm, and a tool feed rate of about 0.3 to 1.5 m/min, especially about 0.5 to 1.0 m/min.

After the roll is ground to a mirror finish with the grinding tool of the invention, the roll is subjected to buffing, plate-making, and chromium-plating steps whereupon the roll is ready for gravure printing. Prior to printing, the roll may be mounted in a proof printing machine to produce a proof sheet, which is visually inspected for printing defects such as variations and streaks.

When a copper-plated roll for main use in gravure printing is wet ground using the porous grinding tool of the invention, the roll can be ground to a mirror finish at a high dimensional precision without leaving streaky feed marks of a large inclination angle, so that the roll ensures the production of prints of high precision and quality. Besides the gravure printing rolls, the porous grinding tool of the invention is also applicable to a variety of applications where surface grinding, especially mirror finish surface grinding is required.

With the grinding tool according to the invention, a roll can be ground within a satisfactory dimensional tolerance. Although the feed marks left on the roll surface due to the feed rate of the grinding tool extend parallel to the circumferential direction of the roll and lie at steep pitches in the prior art, the grinding tool of the invention allows the feed marks to extend transverse (not parallel) to the circumferential direction of the roll and reduces the feed mark pitch inclination angle. As a result, the roll is ground such that no streaky printing defects associated with the feed marks will be produced when the ground roll is used in printing.

EXAMPLE

Examples of the invention are described below by way of illustration and not by way of limitation.

The following instrument and grinding machine were used in Examples.

Surface roughness meter: Talistep (Taylor Hobson Co.)

Grinding machine: vertical cylindrical grinding machine (Sanko Kikai K. K.)

Roll to be ground: a hard copper-plated roll having a diameter of 180 mm, a length of 400 mm, and a Vickers hardness Hv of 200

Examples 1–5 & Comparative Examples 1–3

Water was added to a fully saponified product of polyvinyl alcohol to form an aqueous solution. This solution was mixed with a water-soluble phenolic resin PR-961A (Sumitomo Dures K. K.), to which hydrochloric acid as a catalyst and formaldehyde as a crosslinking agent were added. Further, silicon carbide abrasive grains (GC #2000, mean grain size 7 μm, Shinano Electric Refining Co., Ltd.) were mixed, obtaining a uniform slurry. The slurry was cast into a cylindrical container having a diameter of 215 mm and a height of 500 mm and maintained one day in a hot bath for reaction and solidification. The resulting compact was washed with water for removing the excess of acid and formaldehyde, and dried. The compact was impregnated with an acrylic resin and dried. It was hot worked one day at a temperature of 200° C., yielding a grinding compact. The compact was drilled to form a through-hole, adjusted in thickness, worked on side surfaces, and end-milled by an NC drilling/tapping machine. In this way, there were obtained porous grinding tools of the desired polygonal (n-sided) shape as shown in Table 1.

Figure 7:
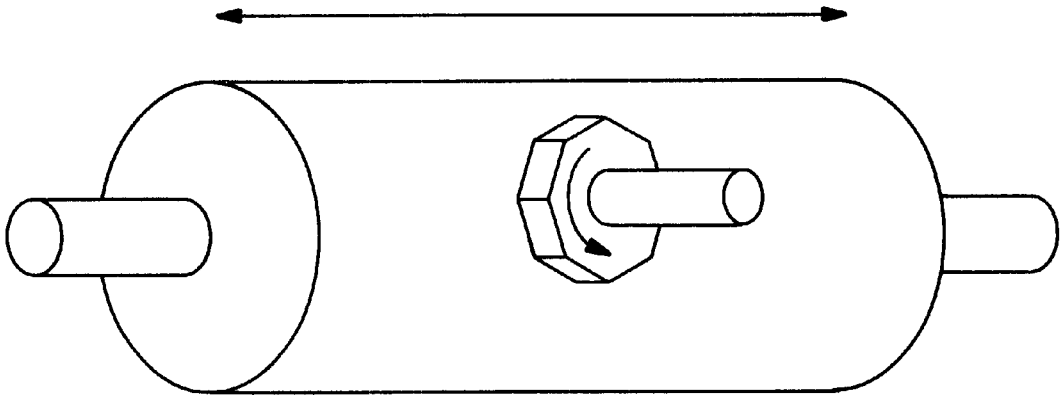
FIG. 7 illustrates an embodiment of the invention for applying a grinding tool with a polygonal shaped abrasive surface to a roll.

Each grinding tool was mounted on the vertical cylindrical grinding machine, which was operated to grind a hard copper-plated roll (defined above) with the grinding tool (see FIG. 7, the arrow showing the reciprocation motion of the grinding tool). While water was applied as a grinding fluid, the roll was ground five strokes under conditions: a tool rotational speed of 500 rpm, a roll rotational speed of 75 rpm, a tool load of 25 kg, and a tool feed rate of 0.5 m/min. The ground roll was inspected for surface state, that is, visually observed for the pattern of feed marks. The surface states of the ground rolls are shown in FIGS. 3 to 6.

The roll ground to a mirror finish was subjected to buffing, plate-making, and chromium-plating steps and then mounted in a proof printing machine to produce a proof sheet, which was visually inspected for printing defects such as variations and streaks (resulting from the feed marks). The results are shown in Table 1.

TABLE 1

| | Example | | | | | Comparative Example | | |
|---|---|---|---|---|---|---|---|---|
| | 1 | 2 | 3 | 4 | 5 | 1 | 2 | 3 |
| Components (wt %) | | | | | | | | |
| Polyvinyl acetal resin | 30 | 30 | 30 | 30 | 30 | 30 | 30 | 30 |
| Phenolic resin | 10 | 10 | 10 | 10 | 10 | 10 | 10 | 10 |
| Acrylic resin | | | | | | | | |
| Abrasive grains | 50 | 50 | 50 | 50 | 50 | 50 | 50 | 50 |
| Abrasive grain mean grain size (μm) | 7 | 7 | 7 | 7 | 7 | 7 | 7 | 7 |
| Grinding tool planar shape (n-sided) | 4 | 6 | 8 | 12 | 20 | 3 | 24 | circle |
| Grinding performance | | | | | | | | |
| Grinding depth (μm) | 3 | 3 | 3 | 3 | 3 | 3 | 3 | 3 |
| Tool wear (μm) | 40 | 30 | 30 | 30 | 30 | 100 | 30 | 30 |
| Surface properties | | | | | | | | |
| Ra (μm) | 0.1 | 0.1 | 0.1 | 0.1 | 0.1 | 0.1 | 0.1 | 0.1 |
| Δ (deg) | 0.64 | 0.72 | 0.85 | 0.93 | 0.95 | 0.55 | 1.10 | 1.12 |
| Sm (μm) | 103 | 355 | 480 | 165 | 100 | 180 | 45 | 33 |
| Feed mark pattern as viewed in roll circumferential direction | chevron (FIG. 4) | oblique chevron (FIG. 5) | oblique chevron | oblique chevron | oblique chevron (FIG. 6) | chevron | parallel | parallel (FIG. 3) |
| Streaky printing defects on proof sheet | none | none | none | none | none | none | found | found |

In the evaluation of ground roll surface properties in Table 1, Ra is a center line mean roughness (μm), Δ is the inclination angle of feed marks, and Sm is the pitch between feed marks.

It is seen from Table 1 that, of the ground roll surface properties, the center line mean roughness Ra remains equal among Examples and Comparative Examples, but the inclination angle of feed marks, designated Δ, becomes smaller as the grinding tool shape departs from the circle, that is, the value of n decreases. It was found that when the inclination angle is small, printing variations and streaky defects are eliminated from the proof sheet. When the grinding tool is triangular (n=3) outside the scope of the invention, the effective area of the tool available for grinding is extremely reduced and the grinding pressure per unit area is, in turn, increased, and the wear of the grinding tool is significantly increased. Except for Comparative Examples 2 and 3, the pattern of feed marks as viewed in the roll circumferential direction is chevron or oblique chevron.

Japanese Patent Application No. 10-202741 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for grinding a surface of a roll having an axis, comprising the steps of rotating the roll about its roll axis, and placing a porous grinding tool in contact with the surface of the rotating roll while rotating the grinding tool about an axis thereof and moving the grinding tool along the axial direction of the roll, thereby grinding the roll surface with the grinding tool to a mirror finish, said grinding tool having an abrasive surface comprised of abrasive grains contained in a cured resin and which is configured to a planar polygonal shape having from four to twenty sides, and said abrasive grains having a mean grain size of about 1 to 40 $\mu$m.

2. The method of claim 1 wherein the roll is rotated at 50 to 150 rpm, said grinding tool is rotated at 300 to 1,000 rpm, and said grinding tool is moved at a feed rate of 0.3 to 1.5 m/min.

3. The method of claim 1 wherein the roll is a gravure printing copper-plated roll.

4. The method of claim 1, wherein the roll is rotated at a speed of 80 to 120 rpm, the grinding tool is rotated at a speed of 500 to 800 rpm and the grinding tool is moved at a tool feed rate of 0.5 to 1.0 m/min.

5. The method of claim 1, wherein the method results in an oblique chevron feed mark pattern as viewed in the roll circumferential direction.

6. The method of claim 1, wherein the abrasive surface has a planar polygonal shape with 6 to 20 sides.

7. The method of claim 1, wherein the resin is a polyvinyl acetal, phenolic, melamine, urea, acrylic, methacrylic, epoxy or polyester resin or a mixture thereof.

* * * * *